United States Patent [19]

Wilt

[11] 4,056,023

[45] Nov. 1, 1977

[54] SINGLE WEB SHEET CUTTER AND STACKER

[75] Inventor: Robert O. Wilt, Cumberland, Md.

[73] Assignee: Westvaco Corporation, New York, N.Y.

[21] Appl. No.: 755,971

[22] Filed: Dec. 30, 1976

[51] Int. Cl.[2] ..... B26H 29/12

[52] U.S. Cl. ..... 83/155; 83/156; 198/812

[58] Field of Search ..... 83/155, 155.1, 156, 83/79, 106; 198/812, 594

[56] References Cited

U.S. PATENT DOCUMENTS

| | | | |
|---|---|---|---|
| 3,203,326 | 8/1965 | Obenshain | 83/23 X |
| 3,272,044 | 9/1966 | Obenshain | 83/79 X |

*Primary Examiner*—J. M. Meister

[57] ABSTRACT

A machine for continuously cutting a web of paper or the like into sheets of different length and then sorting and stacking the sheets includes an improved tape-type delivery means for receiving and conveying the different length sheets from the cutting zone of the machine to the sorting and stacking zones of the machine in equally spaced relation and at tape speed. The sheet receiving and conveying means comprises a plurality of pairs of equally spaced nip rolls, each of which includes a nip opening and closing mechanism, which are mounted on the machine for fore and aft movement in the direction of web travel for receiving and conveying sheets in the range of from about 20 to 80 inches in length.

11 Claims, 4 Drawing Figures

SINGLE WEB SHEET CUTTER AND STACKER

BACKGROUND OF INVENTION

The present invention relates generally to the art of cutting, sorting and stacking paper or the like in sheet form in a continuous operation. More particularly, the present invention relates to an improvement in a tape-type sheet delivery means for such a machine where the machine has the capability of cutting the web into sheets of different length.

The continuous operation is performed at high speed, preferably on a single web of paper, and the final stacked sheets are sold under the trademark AccuTrim paper, marketed by the Assignee herein. The invention is an improvement in the machines disclosed in U.S. Pat. Nos. 3,203,326 and 3,272,044, and incorporates features disclosed in U.S. Pat. No. 3,363,520, all assigned to the Assignee herein. Accordingly, for the purpose of providing a complete disclosure of the present invention, the disclosures of the aforementioned U.S. patents should be considered as incorporated herein by reference.

The present invention resides chiefly in an improvement to the sheet receiving and conveying systems for the machines disclosed in the aforementioned patents. Thus, as applied to the prior art machines, the present invention resides in an improvement to a tape-type, sheet conveying and receiving means. More particularly, the present invention comprises an improved tape-type sheet receiving and conveying means for handling cut sheets of different lengths.

SUMMARY

The present invention relates to a mechanical improvement in the machines disclosed in prior U.S. Pat. Nos. 3,203,326 and 3,272,044, which permits the machines to more readily cut and transport sheets of different length. The machines utilize a rotary knife to cut the web into sheet lengths which are a function of the length of web advanced by the feed rolls during one revolution of the knife cylinder. Thus, the sheet length cut depends upon the relationship of the speed of rotation of the knife cylinder and the speed and radius of the feed rolls. For a feed roll of given radius, the sheet size depends upon the ratio of the angular velocity of the knife cylinder to that of the feed roll. In order to provide an accurately sized sheet, this ratio must be very closely controlled. For this purpose, an electronically adjusted variable ratio drive as disclosed in U.S. Pat. No. 3,736,821, is used. When using the drive means disclosed in the latter patent, the sheet length size can be accurately controlled in infintesimally small increments within the range of from about 20 inches to 80 inches in length simply by selecting the appropriate timing gear and then manipulating the variable drive means. After the sheets are cut, the individual sheets are picked up by a tape-type sheet receiving and conveying means for conveyance to the sheet collecting system.

The sheet pickup system employed on the machines disclosed in the aforementioned patents is comprised of a separate nip roll disposed inside the upper tape run which is selectively moved toward and away from the cutter drum assembly, and, urged toward the lower tape run to form a nip between the two tapes which engages a cut sheet just before it is cut from the web. This arrangement accommodates nearly every possible sheet length, however, the change requires considerable downtime on the machine with attendant labor and economic problems. In addition, since the tapes are set up to run faster than the paper web, the placement of the nip roll is critical, i.e., the nip roll has to be positioned to grip the sheet slightly before the sheet is severed from the web, and this requirement cannot be controlled with any great accuracy on the prior machines. Moreover, once a sheet is in the tape system, it has to be always held in place to prevent slippage and to insure synchronous speed between the sheet and tapes. This last requirement is necessary to maintain proper registration of the sheets as they are delivered to the sheet collecting system. For accomplishing the latter purpose, the present invention is found to be more satisfactory than the previously used spare nip rolls.

The present invention provides a movable and positively adjusted sheet receiving and conveying system for sheets varying from about 20–80 inches in length. The sheet receiving and conveying system is comprised of one or more roller assemblies mounted on a machine frame for movement in the direction of web travel. Each roller assembly is designed to cooperate with a tape-type sheet transporting system and further comprises a pair of upper and lower roller devices which extend transversely across the web from side-to-side with the upper roller of each pair located inside the upper tape run and the lower roller of each pair located inside the lower tape run. A positively controlled mechanical drive and frictionless bearing support system is provided for moving the roller assembly or roller assemblies in unison in the direction of web travel, and the upper roller of each roller assembly pair is mounted in eccentric end bearings for movement into and out of nip relation with the lower roller. In this manner, when the upper roller is brought into nip relation with the lower roller of a roller assembly pair, a nip is created between the upper and lower tapes at that point which causes the tapes to pick-up and grip the cut sheets as they are delivered from the cutting section of the machine. Where more than one roller assembly is provided on the machine, one or more of the upper rollers can be brought into nip relation with the lower rollers as desired. Where the sheet pick up zone is sized to collect sheets as in the present case, i.e., having a length of from about 20–80 inches, when the machine is cutting shorter length sheets, more nips are required to insure proper registry and synchronous speed between the sheets and tapes. Conversely, when the machine is cutting longer length sheets, the spare or un-needed nips must be opened.

In the preferred embodiment disclosed herein, three equally spaced roller assemblies are provided on the machine frame for fore and aft movement in the direction of web travel. The roller assemblies are fixed to one another on equidistant centers and move together as a unit when different length sheets are to be cut.

For conveying the shortest sheets, the roller assemblies are moved into their closest position to the cutter drum assembly and the first pair of rollers is urged into nip relation to form a first sheet receiving nip between the upper and lower tapes. Meanwhile, the other nips can be closed as needed to insure proper sheet registry as noted hereinbefore. For receiving intermediate length sheets, or sheets greater in length than the maximum distance permissable between the cutter drum assembly and the first pair of rollers, the nip between the first rollers is opened, and the nip between the second or middle pair of rollers is closed after adjusting the roller assemblies to their appropriate position. Similarly, as noted above, the third nip could also be closed as required. Finally, when cutting the longest sheets, the roller assemblies are moved to their most remote position from the cutter knife and both the first and second pair of nip rollers are moved out of nip relation while the third or last pair are urged into nip relation.

BRIEF DESCRIPTION

FIG. 2 is a partial side elevational view illustrating in more detail the sheet conveyor system of the apparatus;

DETAILED DESCRIPTION

Figure 1A:
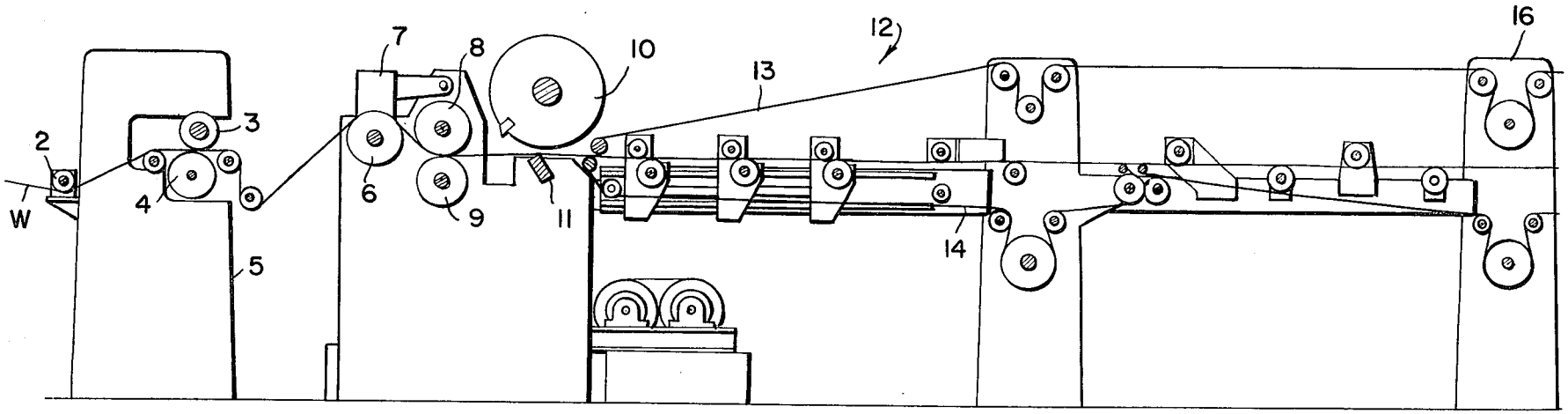
FIGS. 1A and 1B are a side elevational view of an apparatus embodying the present invention.
Figure 1B:
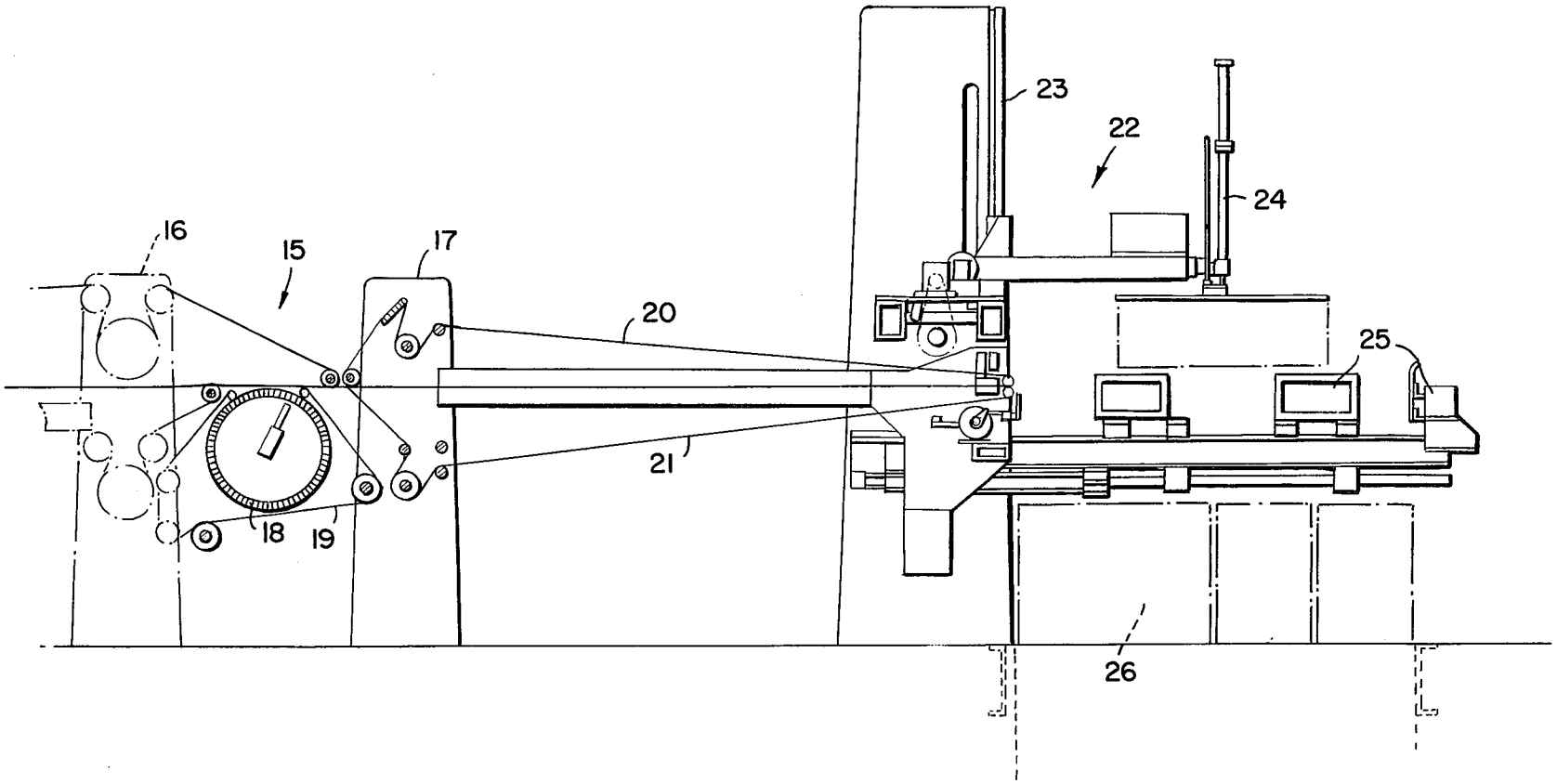

As shown in FIG. 1, a web W of paper or the like is directed from an unwind stand (not shown) at high speed around a constant tension device (not shown) and over a guide roll 2 into a slitter assembly comprised of one or more slitter knives 3 and slitter bells 4. The slitter assembly is mounted on a suitable frame 5 where the incoming web W can be slit (as desired) into two or more individual webs. After the slitter assembly, the web W is passed over other suitably positioned guide rolls prior to passing an inspection station comprising roll 6 and inspection head 7 where the web ( or webs ) is inspected for defects. Subsequent to the inspection station, the web is fed between a pair of feed rolls 8,9 prior to entering a cutting station comprised of cutter drum 10 and bed knife 11. As noted hereinbefore, the length of sheet cut depends on the length of web W fed during a cutting cycle of the conventional flying cutter 10. For this purpose, a common drive means is provided for the cutter drum 10 and web feeding means 8,9. The drive means utilized is that disclosed in the aforementioned U.S. Pat. No. 3,736,821, which permits any chosen one of an infintesimal number of selected lengths of web W to be consistently and precisely fed and cut.

After the sheets are cut, they are directed to a sheet pick-up zone designated generally by the numeral 12 wherein the improvement of the present invention lies. More specifically, sheets leaving the cutter 10 are picked up and transported to the sheet pick-up zone 12 between a plurality of upper tapes 13 and lower tapes 14. The types of tapes, their arrangement on the machine and their function is fully disclosed in the aforementioned prior U.S. Pat. Nos. 3,203,326 and 3,272,044.

As will be further noted in FIG. 1, after the sheets are picked up in the sheet pick-up zone 12, they are transported to the sheet collecting zone generally designated 15. The sheet collecting system is supported between a pair of machine frame members 16 and 17 substantially as disclosed in one or more of the aforementioned prior patents. The sheet collecting system comprises essentially a foraminous collecting drum 18 and tape means 19 more fully disclosed in U.S. Pat. No. 3,363,520. At the sheet collecting zone the sheets are collected in packets and then transferred to the sheet slow down system comprising another set of upper tapes 20 and lower tapes 21. From the slow down tapes, the sheets are delivered to the stacking zone generally designated 22 where the sheets are deposited on a skid (not shown) for wrapping and shipment. The sheet stacker is mounted on a suitable machine frame 23 and comprises a tamper mechanism 24 above the stack, jogger devices 25 on each side of the stack and a skid lift device 26 suitable for handling sheets of different lengths. Since the details of the stacking end of the machine are not a part of the present invention only a schematic disclosure of same has been provided herein.

Figure 3:
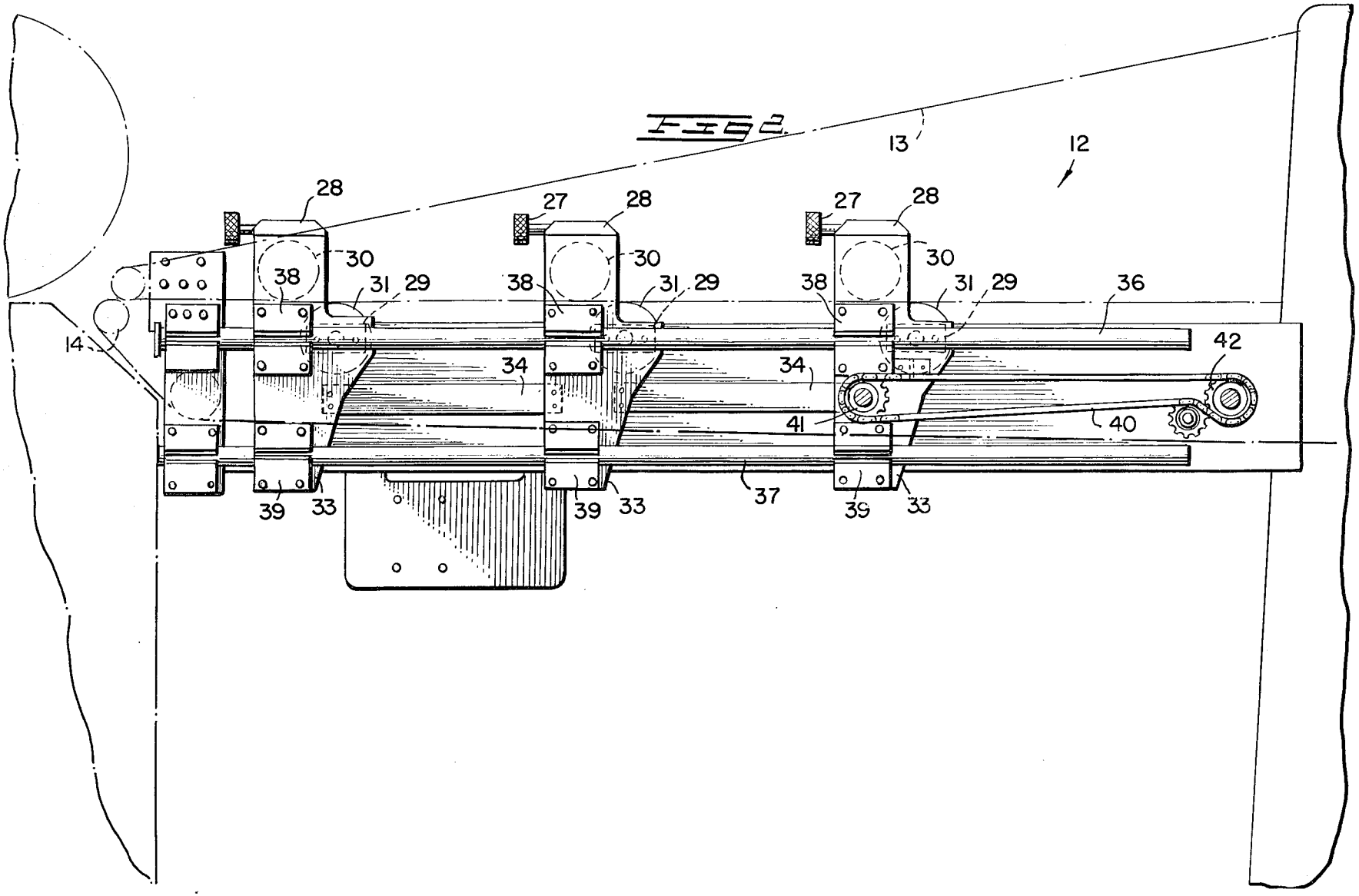
FIG. 3 is a top plan view of the sheet conveyor system illustrated in FIG. 2.
Figure 3:
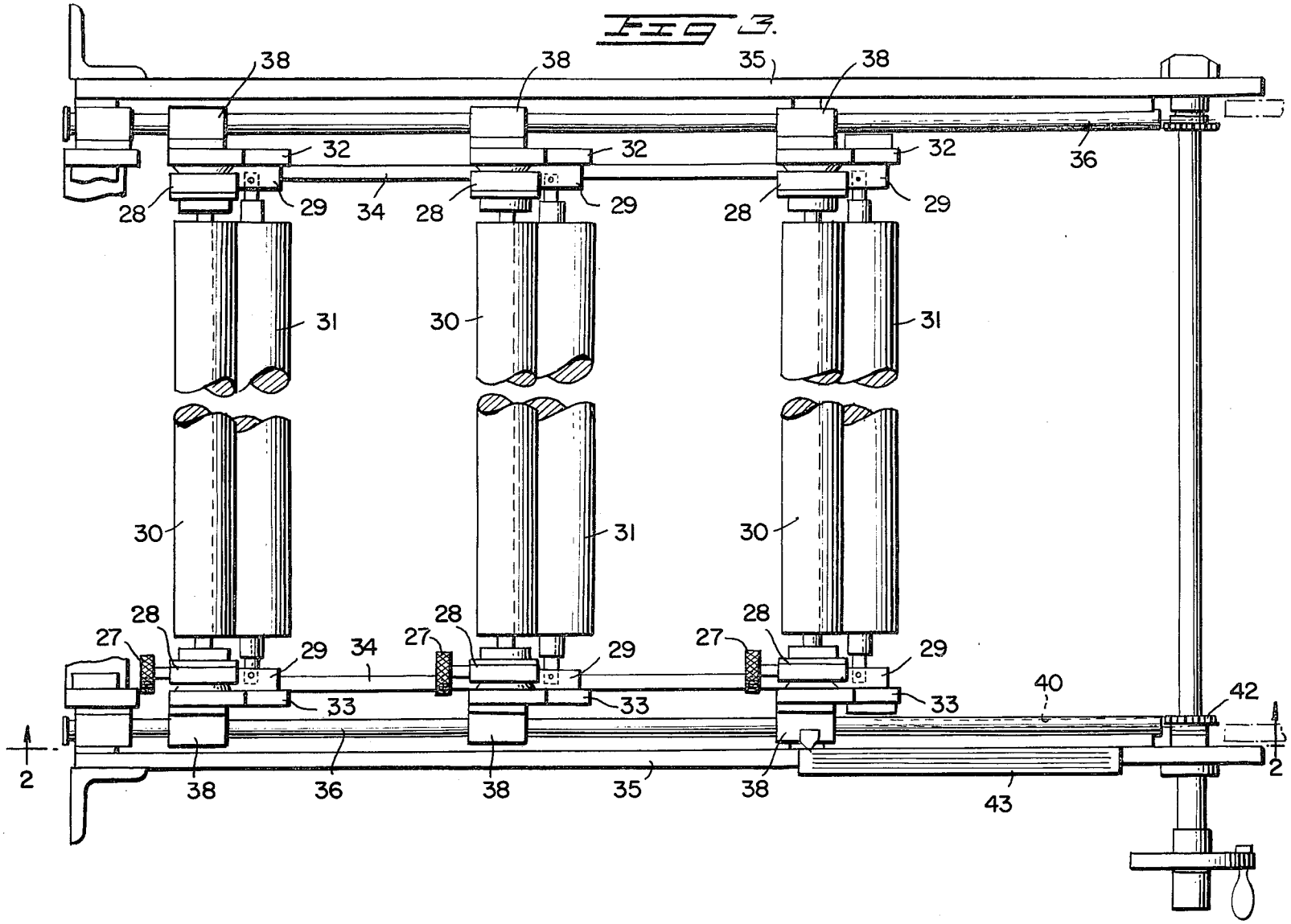

With respect to the improvement of the present invention, FIG. 2 illustrates in more detail the sheet conveyor system of the machine. As noted hereinbefore, when the sheets leave the cutting zone of the machine they must be kept under tension to prevent wrinkling and jam-ups. For this purpose, the tapes 13,14 always run faster than the web W. However, in order to insure that the tapes 13,14 pick up the cut sheets, a gripping action must be provided between the tapes to grip the sheets just before they are cut loose from the web so that the sheets can be quickly accelerated to the greater tape speed. To accomplish this result, a plurality of equally spaced nip creating rollers are provided that are particularly advantageous for use when the machine is alterated for cutting sheets of different lengths. FIGS. 2 and 3 show three pairs of nip rolls 30,31 arranged across the web W that are equally spaced apart in the direction of web travel. The nip rolls 30,31 are journalled at each end between mounting plates 32,33 which are fixedly attached to one another by struts 34. The lower rolls 31 are arranged inside the lower tape system and under the upper run of tapes 14, and, are rotatably journalled in end bearings 29 which are fixed to the mounting plates 32,33. The upper rolls 30 are arranged inside the upper tape system and above the lower run of tapes 13, and are rotatably journalled in Slimb straight line motion bearings 28 which are fixed to the mounting plates 32,33. The Slimb bearings are manufactured by Yorkshire Industries, Inc. Andover, Mass., and are of more fully disclosed in U.S. Pat. No. 3,399,582. The purpose of the Slimb bearings is disclosed in more detail hereinafter. Meanwhile, each mounting plate 32,33 is mounted on side frames 35 of the machine for movement in the web direction. The latter connection is accomplished with the aid of a pair of upper and lower support shafts 36,37 and Thomson ball bushings 38,39 (manufactured by Thomson Industries, Inc. Long Island N.Y.) as shown in FIG. 2. The upper and lower support shafts 36,37 are arranged directly above one another in parallel fashion and are suitably fixed to the machine frame structure 35. The Thomson ball bushings 38,39 are fixedly attached to the mounting plates 32,33 in pillow blocks or the like to accept the support shafts 36,37 for precision alignment of the mounting plates 32,33 and nip rolls 30,31. In addition, because of the nature of the construction of the ball bushings 38,39, a nearly friction free linear motion of the plates 32,33 and nip rolls 30,31 is permitted in the direction of web travel. The latter feature is important when adjusting the nip capability of the machine for cut sheets of different lengths.

In the embodiment of the invention fully disclosed herein, the nip rolls are spaced in 20 inch centers and are provided with 20 inches of linear movement to provide a sheet conveyor capable of accepting sheets in the 20 to 80 inch length range. For machines having different sheet length capability, the different components would be mounted on the machine frame accordingly. The mounting plates 32,33 and nip rolls 30,31 are moved linearly by a hand actuated mechanical drive comprising chain and spocket connections 40,41,42 as shown in FIG. 2. However, it should be understood that any other known drive means could be substituted, as desired, by one skilled in the art. A simple gauge is provided at 43 as shown in FIG. 3 to indicate the placement of the nip rolls 30,31 for a given sheet length. Thus, for the shortest sheet length on the order of about 20 inches, the sheet conveyor system is moved to the left (as shown) as far as possible in the direction of the cutter drum assembly 10. For the longest sheet cut, on the order of about 80 inches, the sheet conveyor would be moved away from the cutter assembly 10 the maximum amount to the right (as shown) by actuating the drive means 40,41,42.

Of course, the simple movement of the sheet conveyor as described above only positions the nip rolls 30,31 along the web direction for the selected sheet size. In order to provide the desired nip for the selected sheet size the appropriate Slimb motion bearing 28 must be actuated. Since it is the function of the Slimb bearing system to produce the simultaneous movement of both ends of a roll or shaft by making an adjustment only at one end of the roll or shaft, adjusting handles 27 are shown only for the Slimb bearings on the front side of the machine. Prior to beginning the cutting operation, the Slimb bearings at 28 are each actuated to open the nip between rolls 30 and 31 as shown. Subsequently, the sheet conveyor is positioned linearly as disclosed hereinbefore for the desired sheet length to be cut. Finally after the latter step the appropriate Slimb bearing 28 is actuated to bring the roll 30 into nip relation with its paired roll 31 and produce a sheet gripping nip at that point between the tapes 13,14. When cutting the shoretest length sheets, or sheets on the order of about 20 inches in length, the sheet conveyor is moved to the left in pick-up zone 12 as far as possible and the first Slimb bearing 28 is closed to provide a first nip for gripping the cut sheets. Meanwhile, other nips can be closed as desired to provide proper sheet registry to the collecting zone. For the longest or 80 inch sheets, the sheet conveyor is moved to the right in pick-up zone 12 as far as possible, the first two Slimb bearings are left open or unactuated, and the third or last Slimb bearing 28 is actuated to provide a sheet gripping nip. For sheet lengths in between the range of 20–80 inches, the sheet conveyor is positioned accordingly and the appropriate Slimb bearing is actuated to provide the desired nip. Since the nip rolls 30,31 are not driven, but simply rotate with the tapes 13,14, one or more Slimb bearings could be closed to form nips for sheets less than 60 inches in length as desired.

Accordingly, it will be understood that the present invention provides a useful sheet conveying mechanism for picking up cut sheets of paper or the like over a range of sheet lengths in infintesimal increments. The fully disclosed embodiment herein accomodates a sheet length range of from about 20 to 80 inches with three nip roll installations. In other embodiments, depending on the sheet length range and accuracy desired, the number of nip roll installations could be reduced or even increased if desired. It will further be understood that while only a preferred embodiment of the invention has been illustrated and described in detail, many variations and modifications could be made by one skilled in the art within the scope of the invention as defined in the appended claims.

I claim:

1. A sheet cutting, conveying and stacking machine comprising in combination, means for advancing a web of material to a sheet cutting device where the web is cut into sheets, a sheet receiving and conveying means for conveying the cut sheets from the cutting device to a sheet collecting station and a sheet slow down means for delivering the cut sheets to a stacking station, the improvement comprising means associated with the sheet receiving and conveying means for receiving and conveying cut sheets of different lengths said means comprising:

a. a roller assembly comprising at least one pair of nip rolls mounted on the machine for fore and aft movement in the direction of web travel;

b. means for selectively opening and closing the nip between said nip rolls; and, c. means for moving the nip rolls linearly toward and away from said cutting device in response to the sheet length cut.

2. The machine of claim 1 wherein the sheet receiving and conveying means is of the tape type and comprises a pair of tape systems consisting of a plurality of upper tapes and a plurality of lower tapes arranged across the web and between which the sheeted paper is conveyed, and the nip rolls comprise at least an upper nip roll and a lower nip roll.

3. The machine of claim 2 wherein the upper nip roll of each pair is located inside the upper tapes and the lower nip roll of each pair is located inside the lower tapes.

4. The machine of claim 3 wherein the upper and lower nip rolls of each pair are journalled at each end in mounting plates located outboard of the upper and lower tape systems.

5. The machine of claim 4 wherein the mounting plates for the nip rolls are suspended, for linear movement of the mounting plates and nip rolls in the direction of web travel, on support shafts located at each side of the machine in the region of the sheet receiving and conveying means.

6. The machine of claim 5 wherein a mechanical means is provided for the upper nip roll of each pair to permit movement of the nip roll into and out of nip engagement with the lower nip roll of each pair.

7. The machine of claim 6 wherein the support shafts for suspending the nip roll mounting plates at each side of the machine further comprise a pair of upper and lower cylindrical rods arranged directly above one another in parallel fashion, which cylindrical rods are fixedly attached to the machine frame structure.

8. The machine of claim 7 wherein the means for suspending the nip roll mounting plates on the upper and lower cylindrical rods further comprises ball bushings which are fixedly attached to the mounting plates.

9. The machine of claim 8 wherein the mechanical means for adjusting the nip configuration of each pair of nip rolls further comprises a pair of straight line motion bearings at each end of the upper nip roll of each pair.

10. The machine of claim 9 wherein the roller assembly comprises at least three individual pairs of nip rolls and mounting plates which are equally spaced apart in the direction of web travel and which are fixedly attached to one another by strut members and the means for moving the mounting plates and nip rolls linearly in the direction of web travel comprises a mechanical drive means attached to one of said mounting plates.

11. A tape-type sheet conveying means comprising a plurality of upper and lower tapes arranged across a machine frame and between which sheets of paper or the like are conveyed, the improvement comprising means for conveying cut sheets of different lengths between said tapes, said means comprising a roller assembly including at least three pairs of nip rolls mounted on the machine frame for fore and aft movement, each pair of said nip rolls including an upper nip roll located inside the upper tapes and a lower nip roll located inside the lower tapes, means for rotatably mounting the ends of said nip rolls in mounting plates located outboard of said upper and lower tapes, means for attaching said mounting plates on said machine frame for linear fore and aft movement, means for selectively opening and closing the nips between said pairs of nip rolls in response to the sheet length conveyed and means for moving the paired nip rolls linearly fore and aft along said machine frame.

* * * * *